US010232498B2

(12) United States Patent
Nishida et al.

(10) Patent No.: US 10,232,498 B2
(45) Date of Patent: Mar. 19, 2019

(54) DRIVING MACHINE

(71) Applicant: Hitachi Koki Co., Ltd., Tokyo (JP)

(72) Inventors: Masashi Nishida, Ibaraki (JP); Yoshimitsu Iijima, Ibaraki (JP); Masaya Nagao, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 525 days.

(21) Appl. No.: 14/951,498

(22) Filed: Nov. 25, 2015

(65) Prior Publication Data

US 2016/0151901 A1 Jun. 2, 2016

(30) Foreign Application Priority Data

Nov. 28, 2014 (JP) ..... 2014-242037

(51) Int. Cl.
*B25C 1/18* (2006.01)
*B25C 1/00* (2006.01)

(52) U.S. Cl.
CPC ..... *B25C 1/008* (2013.01); *B25C 1/184* (2013.01)

(58) Field of Classification Search
CPC ..... B25C 1/008; B25C 1/047; B25C 1/001
USPC ..... 227/8, 119, 142, 149
See application file for complete search history.

(56) References Cited

U.S. PATENT DOCUMENTS 5,238,167 A * 8/1993 Howard ..... B25C 7/00 227/110
5,452,835 A * 9/1995 Shkolnikov ..... B25C 1/047 227/110
5,810,239 A * 9/1998 Stich ..... B25C 7/00 227/119
6,193,126 B1 * 2/2001 Lee ..... B25C 5/0257 227/123
6,708,860 B1 * 3/2004 Thieleke ..... B25C 1/184 227/119
6,789,718 B2 * 9/2004 Canlas ..... B25C 7/00 227/107

(Continued)

FOREIGN PATENT DOCUMENTS

JP 2003-252017 9/2003
JP 2004-216471 8/2004

(Continued)

OTHER PUBLICATIONS

"Office Action of Taiwan Counterpart Application," with machine English translation thereof, dated Oct. 2, 2018, pp. 1-10.

*Primary Examiner* — Robert Long
(74) *Attorney, Agent, or Firm* — JCIPRNET

(57) ABSTRACT

A driving machine is provided to prevent clogging of a fastener in an ejection passage without increasing the total length of the ejection passage. A nail driving machine includes: a nose part forming an upper portion of an ejection passage through which a nail passes; a contact part being slidable along the nose part and forming a lower portion of the ejection passage; a driver blade striking a head part of the nail supplied to the ejection passage; and a guide part disposed in a lower portion of the nose part and guiding the nail passing through the ejection passage. The guide part has a guide surface inclining to protrude from a radial outer side toward a radial inner side of the ejection passage. A housing groove is formed in the contact part and the guide part enters the housing groove when the contact part slides along the nose part.

7 Claims, 9 Drawing Sheets

(56) References Cited

U.S. PATENT DOCUMENTS

| | | | | |
|---|---|---|---|---|
| 6,808,101 | B2 * | 10/2004 | Laubach | B25C 1/005 227/109 |
| 6,820,788 | B2 * | 11/2004 | Akiba | B25C 1/008 227/130 |
| 8,220,687 | B2 * | 7/2012 | Yamamoto | B25C 1/008 227/120 |
| 2003/0218044 | A1 * | 11/2003 | Laubach | B25C 1/005 227/109 |
| 2004/0050899 | A1 * | 3/2004 | Canlas | B25C 7/00 227/119 |
| 2006/0157527 | A1 * | 7/2006 | Yamamoto | B25C 1/008 227/8 |
| 2006/0180628 | A1 * | 8/2006 | Hung | B25C 1/008 227/8 |
| 2006/0255088 | A1 * | 11/2006 | Kubo | B25C 1/008 227/119 |
| 2007/0012744 | A1 * | 1/2007 | Losada | B25C 1/005 227/107 |
| 2008/0179372 | A1 * | 7/2008 | Kurth | B25C 1/184 227/136 |
| 2008/0277446 | A1 * | 11/2008 | Yamamoto | B25C 1/008 227/139 |
| 2013/0134204 | A1 * | 5/2013 | Morioka | B25C 1/003 227/9 |
| 2015/0014388 | A1 * | 1/2015 | Moriwaki | B25C 1/188 227/119 |

FOREIGN PATENT DOCUMENTS

| | | |
|---|---|---|
| JP | 2005-001076 | 1/2005 |
| JP | 5348456 | 11/2013 |
| JP | 2014083656 | 5/2014 |

* cited by examiner

DRIVING MACHINE

CROSS-REFERENCE TO RELATED APPLICATION

This application claims the priority benefit of Japan application serial no. 2014-242037, filed on Nov. 28, 2014. The entirety of the above-mentioned patent application is hereby incorporated by reference herein and made a part of this specification.

BACKGROUND OF THE INVENTION

Field of the Invention

The invention relates to a driving machine for driving a fastener, such as nail and pin, into an object to be fixed.

Description of Related Art

A driving machine is known for driving a fastener with a head part that is on one end of a shaft part and has a larger diameter than the shaft part (nail, screw, pin, and so on, for example) into an object to be fixed, such as flooring and a wall material (e.g. Japanese Patent No. 5348456). This type of driving machine is provided with a magazine in which a plurality of fasteners are stored, an ejection passage that sequentially supplies the fasteners from the magazine, and a driver blade that strikes the head part of the fastener supplied to the ejection passage. The fastener struck by the driver blade on the head part is punched out from the front end (ejection port) of the ejection passage through the ejection passage and is driven into the object to be fixed.

The ejection passage is constituted by a nose part and a contact part disposed in the lower part of the nose part. The contact part is slidable (vertically movable) along the nose part. Under the state that the front end of the contact part abuts the object to be fixed, when the driving machine body is pressed against the object to be fixed, a portion of the nose part is pushed into the contact part. In other words, the contact part is pushed up along the nose part. In this way, if the trigger is pulled while the nose part is pushed up, the driver blade is driven and the fastener in the ejection passage is struck by the driver blade. On the other hand, in a state that the nose part has not been pushed up, the driver blade will not be driven even if the trigger is pulled. That is, the contact part not only forms a part of the ejection passage but also functions as a switch part that is necessary for the sequence of operations of driving the fastener.

PRIOR ART LITERATURE

Patent Literature

Patent Literature 1: Japanese Patent No. 5348456

SUMMARY OF THE INVENTION

Problem to be Solved

As described above, the ejection passage of the driving machine is constituted by two members (the nose part and the contact part). Thus, between the nose part and the contact part, there is a gap which is necessary for sliding or machining accuracy or a gap for height adjustment which is required for correcting the driving depth. For this reason, a gap recessed on the radial outer side of the ejection passage may exist in the middle of the ejection passage, and the head part of the fastener may fall into the gap. If the head part of the fastener falls into the gap, the fastener cannot be punched out and will clog the ejection passage.

Here, while the entire fastener is in the ejection passage, tilt of the fastener is restricted by the inner peripheral surface of the ejection passage. In other words, once a portion of the fastener leaves the ejection port, the tilt-restricting effect of the inner peripheral surface of the ejection passage decreases and the fastener may tilt easily. Therefore, the head part of the fastener is more likely to fall into a gap located closer to the ejection port. Accordingly, if the total length of the contact part is increased to keep the position of the gap far away from the ejection port, the possibility of the head part of the fastener falling into the gap can be reduced.

As the total length of the contact part increases, however, the total length of the ejection passage increases, and the overall height of the driving machine would also increase.

The invention is to prevent clogging of the fastener in the ejection passage without increasing the total length of the ejection passage.

Solution to the Problem

The invention provides a driving machine for driving a fastener, which includes a head part formed on an end of a shaft part and having a larger diameter than the shaft part, into an object to be fixed. The driving machine includes: a nose part forming an upper portion of an ejection passage through which the fastener passes; a contact part being slidable along the nose part and forming a lower portion of the ejection passage; a driver blade striking the head part of the fastener supplied to the ejection passage; and a guide part disposed in a lower portion of the nose part and guiding the fastener passing through the ejection passage. The guide part has a guide surface that inclines to protrude from a radial outer side toward a radial inner side of the ejection passage. A housing groove is formed in the contact part and the guide part enters the housing groove when the contact part slides along the nose part.

In an embodiment of the invention, ½ or more of the guide part enters the housing groove.

In another embodiment of the invention, a portion of the guide surface of the guide part housed in the housing groove forms an inner peripheral surface of the ejection passage with an inner peripheral surface of the contact part.

In another embodiment of the invention, a width of the housing groove is smaller than the diameter of the head part of the fastener.

In another embodiment of the invention, when the head part of the fastener is in contact with a portion of the guide part that is closest to a center of the ejection passage, at least a portion of the head part is located in the ejection passage.

In another embodiment of the invention, the nose part and the guide part are individual parts, and an engaging member is interposed between the nose part and the guide part.

In another embodiment of the invention, a buffer member is interposed between the nose part and the guide part.

Effects of the Invention

According to the invention, it is possible to prevent clogging of the fastener in the ejection passage without increasing the total length of the ejection passage.

DESCRIPTION OF THE EMBODIMENTS

Hereinafter, an exemplary embodiment of the driving machine of the invention is described in detail with reference to the figures. The driving machine of this embodiment is a nail driving machine that uses compressed air as the power source to drive a nail, an example of the fastener, into the object to be fixed.

Figure 1:
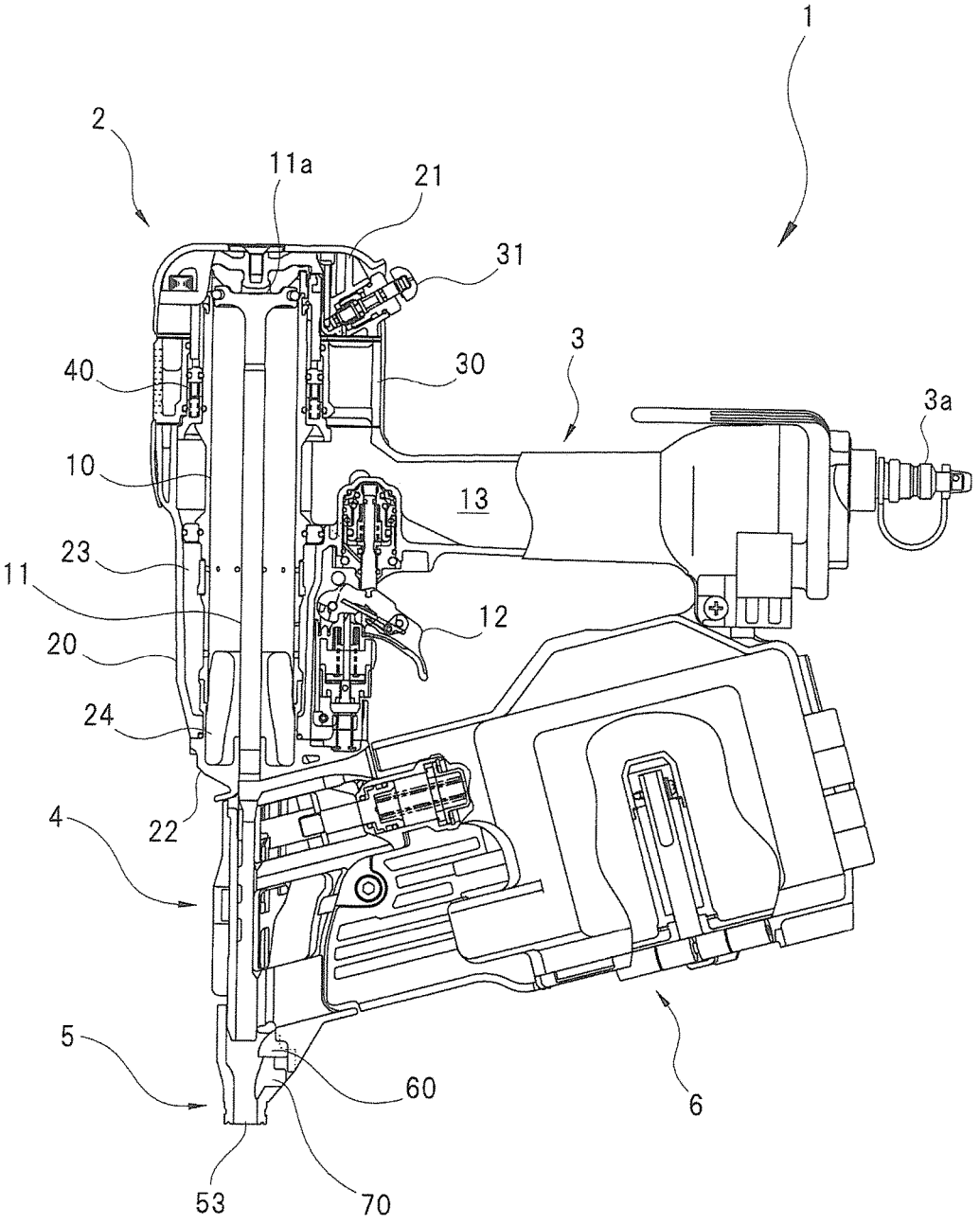
FIG. 1 is a cross-sectional view of the nail driving machine according to the invention.

As shown in FIG. 1, a nail driving machine 1 includes a body 2, a handle 3 that extends from a side surface of the body 2 in a direction intersecting the longitudinal direction of the body 2, a nose part 4 disposed at an end of the body 2, a contact part 5 disposed at an end of the nose part 4, and a magazine device 6 extending across the handle 3 and the nose part 4. In addition, the contact part 5 may also be called a "contact nose."

In the following description, the longitudinal direction of the body 2 is defined as the vertical direction and the side of the body 2 close to the handle 3 is defined as the upper side. Further, the longitudinal direction of the handle 3 is defined as the front-rear direction, and the side where the body 2 is disposed is defined as the front and the opposite side is defined as the rear. According to such definition, the nose part 4 is disposed at the lower end of the body 2 and the contact part 5 is disposed at the lower end of the nose part 4. Moreover, the handle 3 extends rearward from the body 2.

A cylindrical cylinder 10 is housed inside the body 2. A driver blade 11 (may also called a "drive bit") is housed inside the cylinder 10 in a vertically movable (reciprocating) manner. A piston head 11*a* is formed integrally with an end of the driver blade 11. The piston head 11*a* slides on the inner peripheral surface of the cylinder 10 along with the vertical movement of the driver blade 11. A seal member such as an O-ring is fitted to the outer peripheral surface of the piston head 11*a* such that the airtightness between the outer peripheral surface of the piston head 11*a* and the inner peripheral surface of the cylinder 10 is ensured.

When a trigger 12 as shown is operated in a state where a predetermined condition is satisfied, compressed air is supplied to the upper chamber (the space above the piston head 11*a*) of the cylinder 10 and the driver blade 11 is pushed down by the pressure of the compressed air. When the driver blade 11 is pushed down, a nail (not shown) sequentially supplied from the magazine device 6 is struck by the lower end surface of the driver blade 11 and driven into an object to be fixed (not shown).

In this embodiment, when the trigger 12 is operated in a state where the nose part 4 is pushed down with respect to the contact part 5 (that is, a state where the contact part 5 is pushed up with respect to the nose part 4), compressed air is supplied to the cylinder 10 and the driver blade 11 is driven by the pressure of the compressed air. Details are described specifically below.

As shown in FIG. 1, the body 2 includes a tubular housing 20, a head cover (may also called an "exhaust cover") 21 disposed on the upper side of the housing 20, and an under cover 22 disposed at the lower end of the housing 20. In addition, an annular member 30 surrounding the upper portion of the cylinder 10 is disposed between the upper end of the housing 20 and the head cover 21. An air duster 31 is disposed on the upper side of the annular member 30. The annular member 30 in this embodiment is an aluminum member made by metal mold casting.

The annular member 30 has a hollow structure and the inner space of the annular member 30 communicates with the inner space of the handle 3. A connecting plug 3*a* which communicates with the inner space of the handle 3 is disposed at an end of the handle 3, and compressed air is supplied to the inner space of the handle 3 and the inner space of the annular member 30 which communicates with the inner space of the handle 3 via an air compressor (not shown) that is connected to the connecting plug 3*a*. The compressed air supplied to these inner spaces is supplied to the upper chamber of the cylinder 10 when the trigger 12 is operated, so as to push down the driver blade 11. That is, the inner space of the annular member 30 and the inner space of the handle 3 form an accumulation chamber 13 for storing the compressed air to be supplied to the cylinder 10.

In the upper portion of the body 2, a main valve 40 is disposed for switching between a first state and a second state, wherein the first state blocks communication between the accumulation chamber 13 and the cylinder 10, and the second state allows communication between the accumulation chamber 13 and the cylinder 10. When the trigger 12 is operated in a state where the contact part 5 is pushed up, the main valve 40 is opened (switched from the first state to the second state) and the compressed air is supplied to the upper chamber of the cylinder 10 as described above.

Moreover, a return chamber 23 communicating with the interior of the cylinder 10 through two ports, i.e. an upper port and a lower port, is formed around the cylinder 10. One port (upper port) disposed on the upper side is provided with a one-way valve (check valve), which allows air to flow from the cylinder 10 into the return chamber 23 and does not allow air to flow from the return chamber 23 into the cylinder 10. In contrast thereto, the other port (lower port) disposed on the lower side is not provided with any valve.

When the main valve 40 is switched from the first state to the second state in accordance with the operation of the trigger 12 and the driver blade 11 is lowered, the air in the lower chamber (the space under the piston head 11*a*) of the cylinder 10 flows into the return chamber 23 via the upper port and the lower port. After the piston head 11*a* passes the upper port, the air in the upper chamber of the cylinder 10 flows into the return chamber 23 from the upper port and subsequently the air in the lower chamber of the cylinder 10 flows into the return chamber 23 from the lower port.

On the other hand, when the operation of the trigger 12 is released to switch the main valve 40 from the second state to the first state to block the communication between the accumulation chamber 13 and the cylinder 10, and an exhaust path (not shown) is opened, the compressed air flows (flows back) into the cylinder 10 from the return chamber 23 via the lower port to push up the driver blade 11. It should be noted that the driver blade 11 shown in FIG. 1 is located at the top dead center. The driver blade 11 shown in FIG. 1 is lowered to a position (bottom dead center) where the piston head 11*a* collides with a piston bumper 24 disposed in the lower portion of the cylinder 10.

Figure 2:
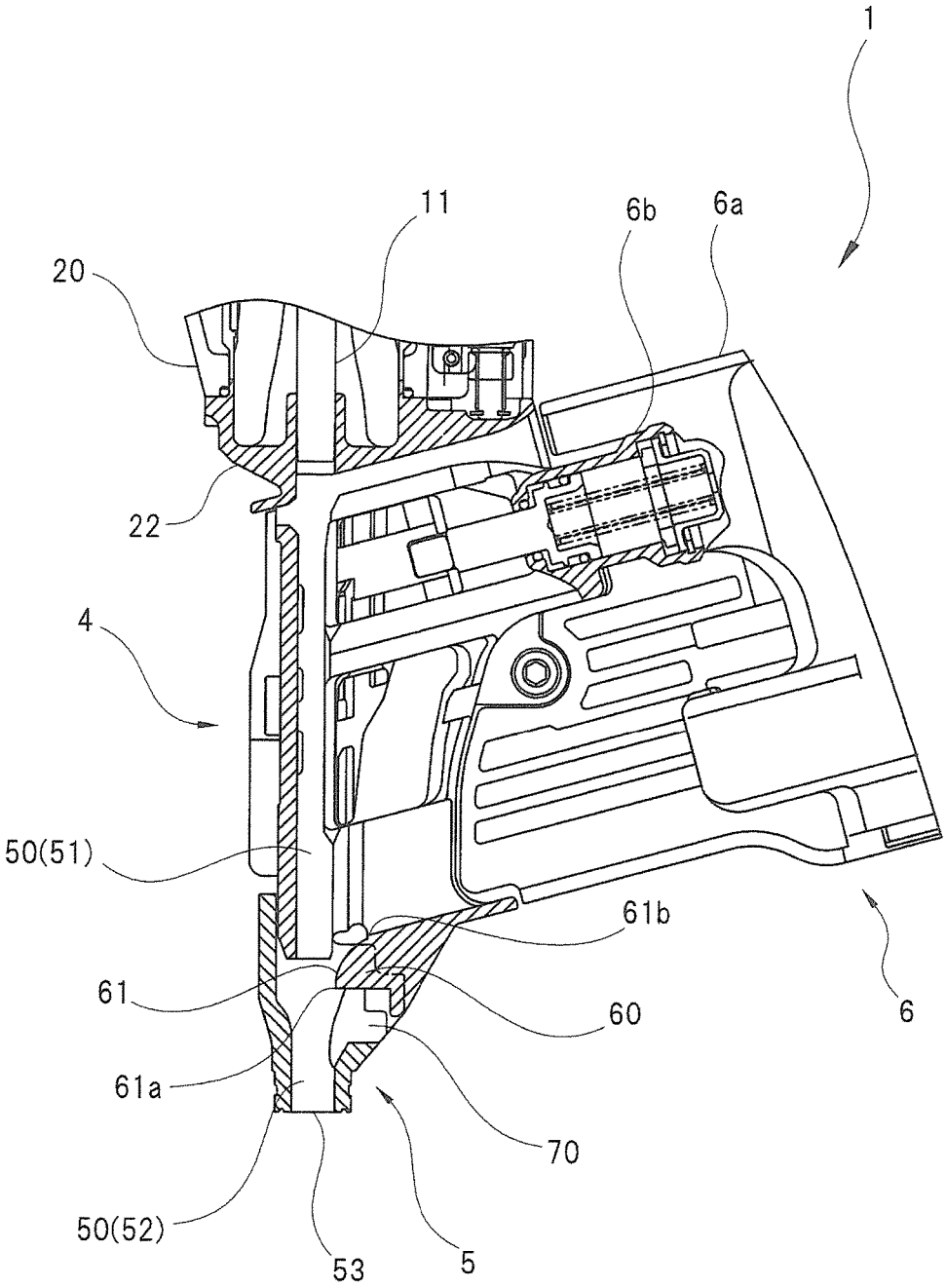
FIG. 2 is a partially enlarged cross-sectional view of the nail driving machine shown in FIG. 1.

As shown in FIG. 2, the nose part 4 extending in the same direction as the housing 20 is disposed under the under cover 22 of the housing 20 and the contact part 5 extending in the same direction as the nose part 4 is disposed at the lower end of the nose part 4. The contact part 5 is slidable with respect to the nose part 4 and is constantly forced downward by a spring (not shown). When the contact part 5 is pressed against the object to be fixed (not shown), the contact part 5 is pushed up along the nose part 4 against the force of the spring. When the trigger 12 (FIG. 1) is operated in the state where the contact part 5 is pushed up, the compressed air is supplied to the cylinder 10 (FIG. 1) and the driver blade 11 is lowered as previously described.

The nose part 4 has an inner space having a substantially U-shaped cross-sectional shape and the contact part 5 has an inner space having a substantially cylindrical cross-sectional shape. The inner space of the nose part 4 and the inner space of the contact part 5 communicate with each other to form a series of ejection passages 50. The magazine device 6 includes a magazine 6*a* for housing a plurality of nails that are bound and a supply mechanism (feeder 6*b*) for sequentially supplying the nails housed in the magazine 6*a*. The nails are sequentially supplied into the ejection passage by the feeder 6*b* of the magazine device 6.

As described above, a portion (upper portion) of the ejection passage 50 is formed by the nose part 4 and another portion (lower portion) of the ejection passage 50 is formed by the contact part 5. In other words, in the ejection passage 50, the portion formed by the nose part 4 is the upper portion and the portion formed by the contact part 5 is the lower portion. In the following description, the portion of the ejection passage 50 formed by the nose part 4 may be called an "ejection passage upper portion 51" and the another portion of the ejection passage 50 formed by the contact part 5 may be called an "ejection passage lower portion 52". The nails (not shown) are supplied to the ejection passage upper portion 51 by the feeder 6*b*. Meanwhile, the driver blade 11 strikes the head part of the nail that has been supplied to the ejection passage upper portion 51. The nail that has been struck on the head part sequentially passes through the ejection passage upper portion 51 and the ejection passage lower portion 52 and is punched out from the lower end (ejection port 53) of the ejection passage 50.

Here, a plate-shaped guide part 60 for guiding the nail that passes through the ejection passage 50 is formed integrally with the lower portion of the nose part 4. The guide part 60 has a guide surface 61 facing the ejection passage 50. The guide surface 61 is a curved surface that inclines downward and protrudes from the radial outer side toward the radial inner side of the ejection passage 50. A lower end 61*a* of the guide surface 61 is closest to the center of the ejection passage 50 while an upper end 61*b* of the guide surface 61 is farthest from the center of the ejection passage 50. Since the guide surface 61 is the curved surface described above, the side shape of the guide part 60 as a whole is substantially fan-shaped. Moreover, in the guide part 60, the lower end 61*a* of the guide surface 61 is the portion closest to the center of the ejection passage 50.

Nevertheless, the lower end 61*a* of the guide surface 61 is disposed outside the ejection port 53, so as to prevent interference between the driver blade 11 and the guide part 60. In other words, the lower end 61*a* of the guide surface 61 is slightly retracted toward the radial outer side from the edge of the ejection port 53. In this embodiment, the lower end 61*a* of the guide surface 61 is retracted about 0.5 mm from the edge of the ejection port 53.

Figure 3:
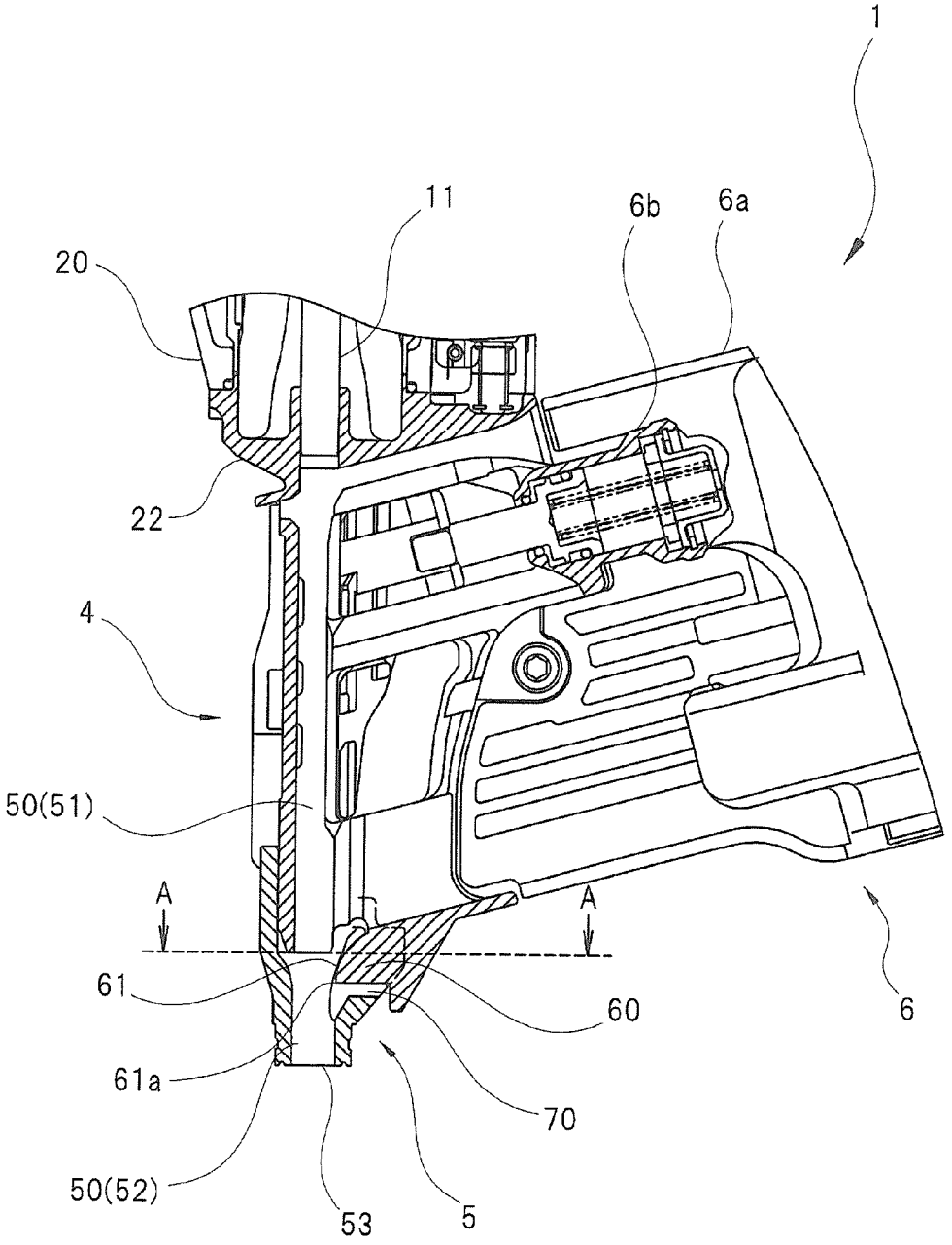
FIG. 3 is another partially enlarged cross-sectional view of the nail driving machine shown in FIG. 1.
Figure 4:
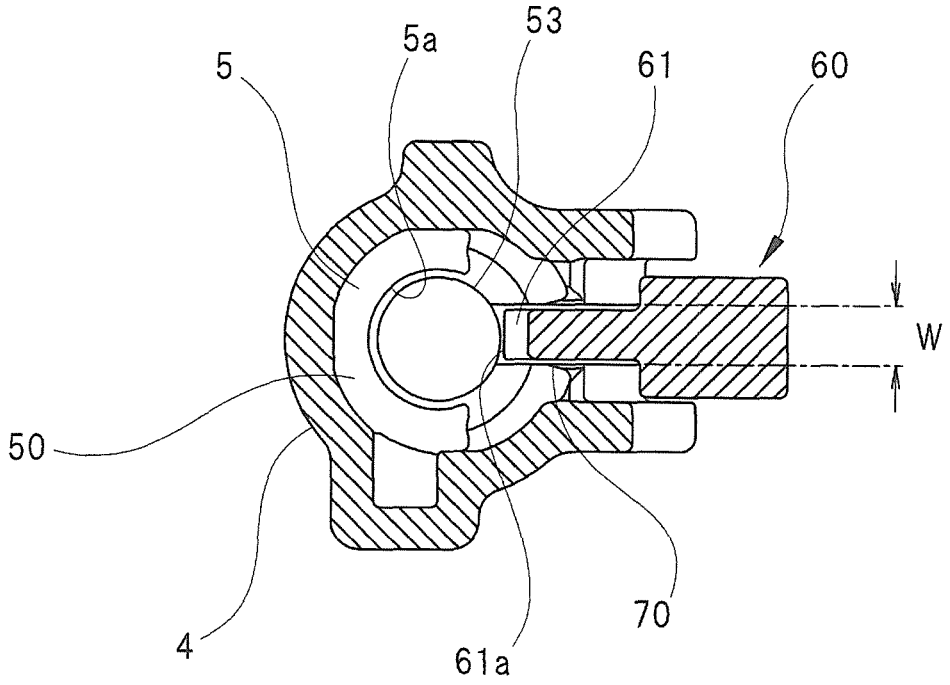
FIG. 4 is a cross-sectional view taken along the line A-A shown in FIG. 3.

Further, a slit-shaped housing groove 70 corresponding to the guide part 60 is formed in the upper portion of the contact part 5. As shown in FIG. 3 and FIG. 4, when the contact part 5 slides along the nose part 4 (when the contact part 5 is pushed up), the guide part 60 enters the housing groove 70. In other words, when the nose part 4 slides along the contact part 5 (when the nose part 4 is pushed down), the guide part 60 enters the housing groove 70. That is to say, when the nose part 4 is pushed down, the guide part 60 is housed in the housing groove 70. In this embodiment, the height of the guide part 60, the depth of the housing groove 70, the stroke of the contact part 5, and so on are set such that ½ or more of the guide part 60 including the guide surface 61 can enter the housing groove 70.

As shown in FIG. 4, when the guide part 60 enters the housing groove 70, the lower end 61*a* of the guide surface 60 forms a portion of the inner peripheral surface of the ejection passage 50. More specifically, the lower end 61*a* of the guide surface 61 of the guide part 60 that enters the housing groove 70 forms the inner peripheral surface of the ejection passage lower portion 52 with an inner peripheral surface 5*a* of the contact part 5.

As described above, in the nail driving machine 1 of this embodiment, the ejection passage 50 is formed by the nose part 4 and the contact part 5. In addition, the guide part 60 having the guide surface 61 is disposed in the nose part 4 that forms the ejection passage upper portion 51, and the housing groove 70 where the guide part 60 enters is formed in the contact part 5 that forms the ejection passage lower portion 52. With the nail driving machine 1 of this embodiment that has such a structure, clogging of the nail in the ejection passage is prevented or reduced in the following manner.

Figure 5:
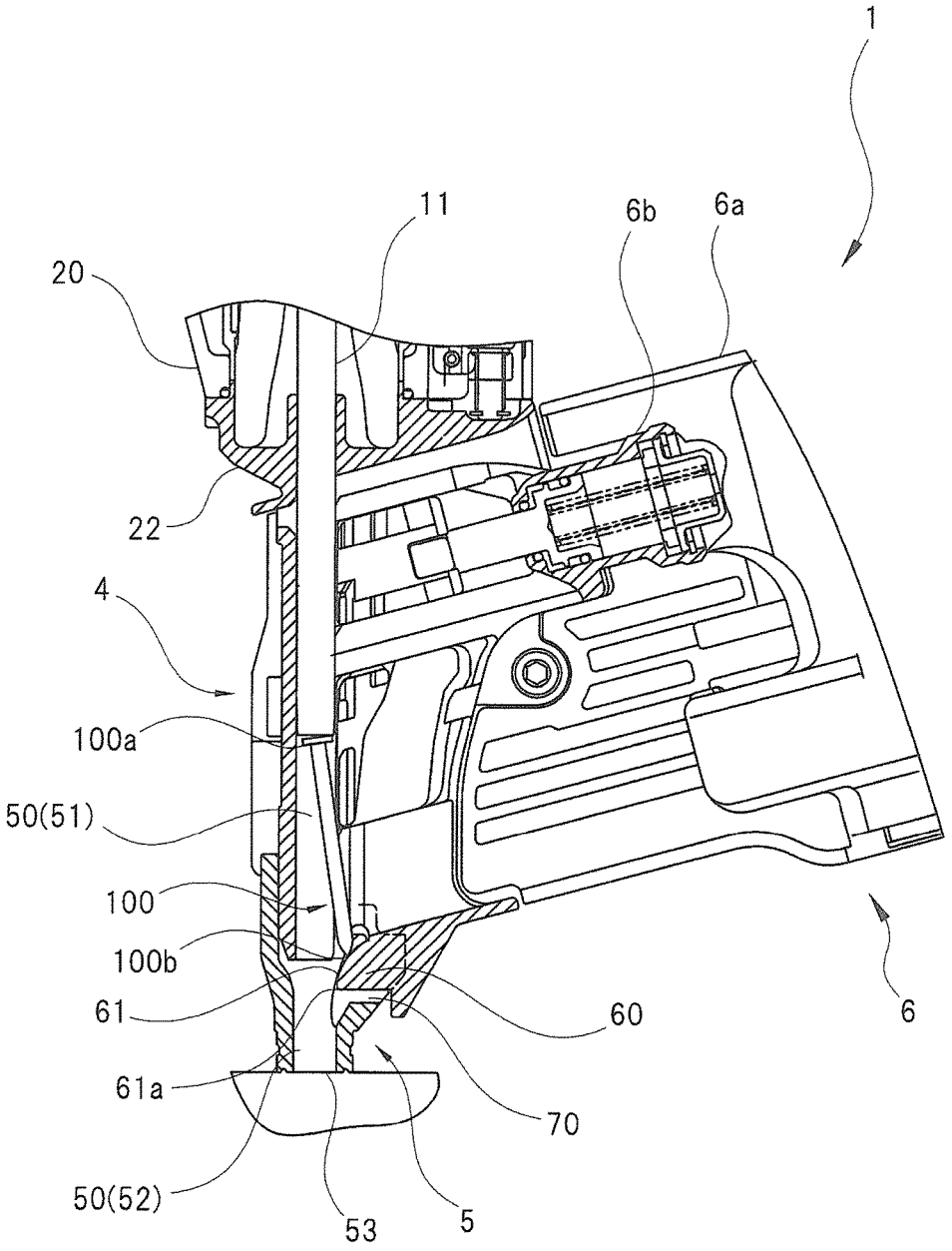
FIG. 5 is a partially enlarged cross-sectional view showing a tilt state of the nail in the ejection passage.

Please refer to FIG. 5. A nail 100 supplied into the ejection passage by the magazine device 6 is struck by the driver blade 11. The nail 100 has a head part 100*a* formed on one end of a shaft part, and the head part 100*a* has a larger diameter than the shaft part. The other end of the shaft part is sharpened. In the following description, the sharpened end of the shaft part is called a "front end 100*b*". The driver blade 11 strikes the head part 100*a* of the nail 100, and the nail 100 struck on the head part 100*a* is punched out from the ejection port 53 through the ejection passage 50. At the moment, the nail 100 may tilt forward, rearward, to the left, or to the right in the ejection passage. That is, as shown in FIG. 5, the nail 100 may tilt with the front end 100*b* of the nail 100 behind the head part 100*a*. In the following description, a tilt state of the nail 100 as shown in FIG. 5 is called "forward tilting" and a tilt state opposite to the forward tilting is called "rearward tilting". That is, the rearward tilting refers to the tilt state where the front end 100*b* of the nail 100 is located in front of the head part 100*a*.

As shown in FIG. 5, when the nail 100 tilts forward in the ejection passage, the front end 100*b* of the nail 100 is in contact with the guide surface 61 of the guide part 60. Since the guide surface 61 inclines to protrude from the radial outer side toward the radial inner side of the ejection passage 50, the front end 100*b* of the nail 100 in contact with the guide surface 61 is returned toward the center of the ejection passage 50. Consequently, the forward tilting of the nail 100 is corrected.

Figure 6:
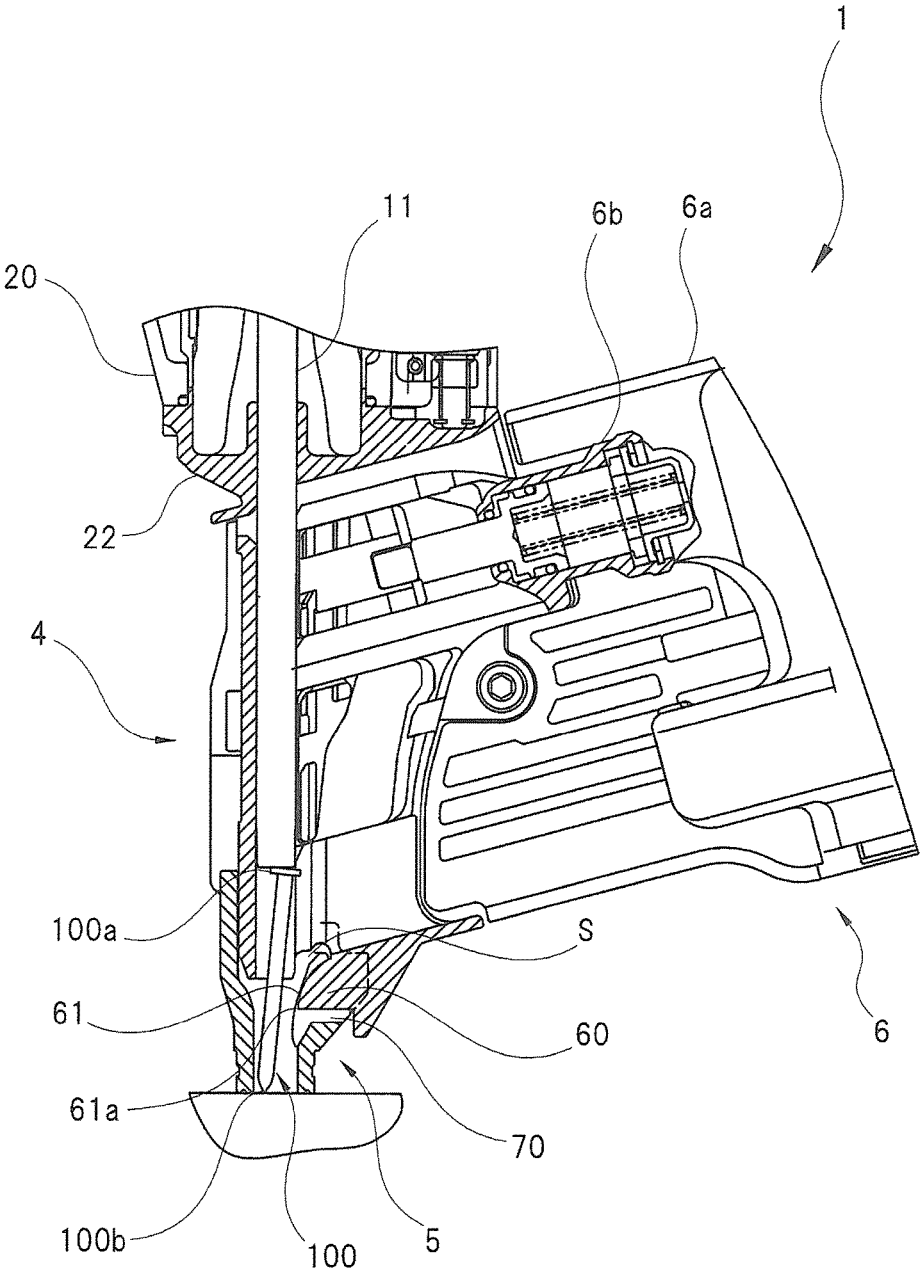
FIG. 6 is a partially enlarged cross-sectional view showing another tilt state of the nail in the ejection passage.

On the other hand, when the front end 100*b* of the nail 100 is returned toward the center of the ejection passage 50 by the guide surface 61, the head part 100*a* of the nail 100 may fall rearward easily. That is, the tilt state of the nail 100 is likely to change from forward tilting to rearward tilting. Then, as shown in FIG. 6, when the nail 100 in the rearward tilting state starts to be driven into the object to be fixed, a part of the striking force of the driver blade 11 pushes the head part 100*a* rearward. As a result, the head part 100*a* of the nail 100 falls into a gap S between the nose part 4 and the contact part 5, which may cause the nail 100 to clog.

Figure 7:
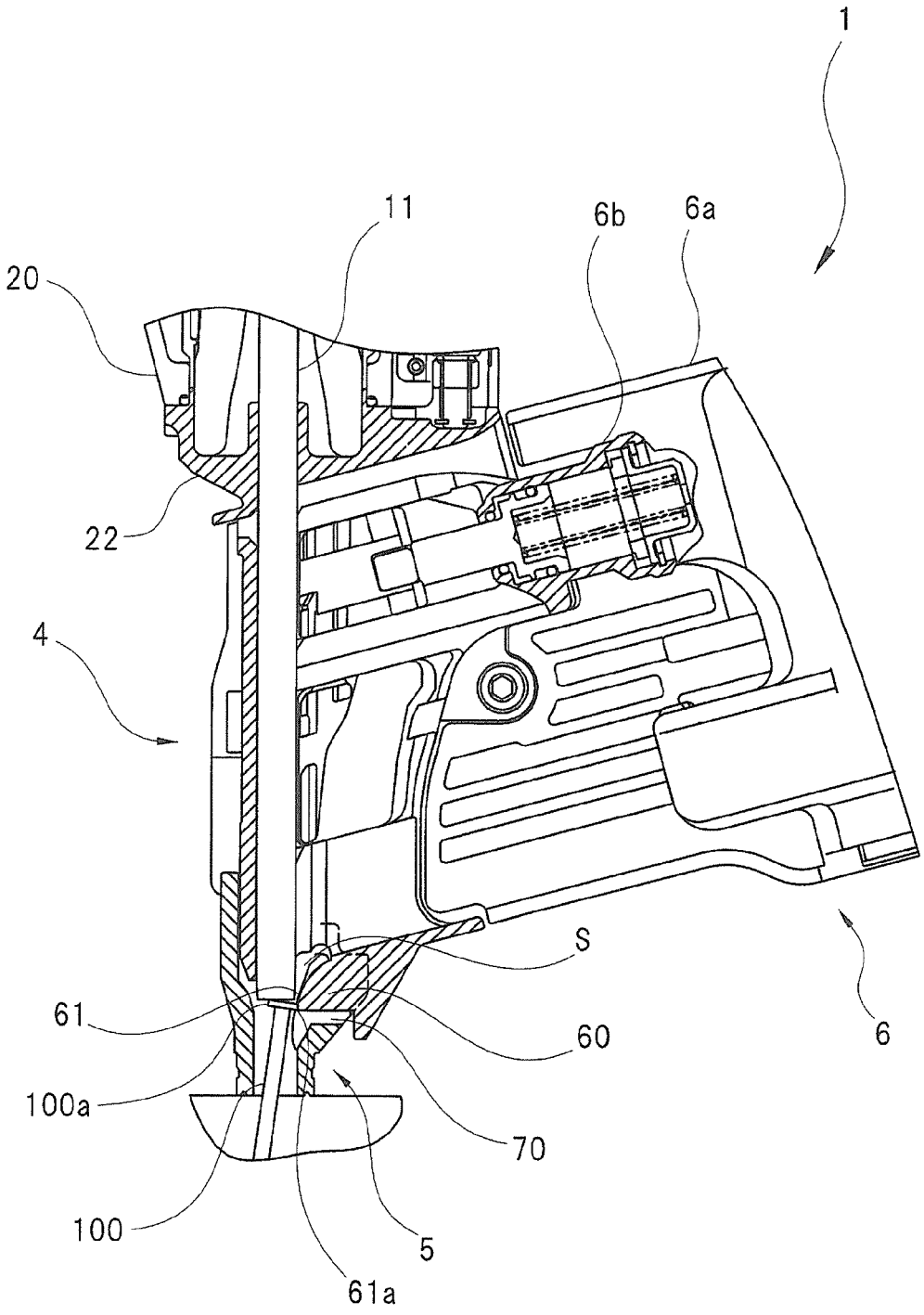
FIG. 7 is a partially enlarged cross-sectional view showing another tilt state of the nail in the ejection passage.

In this embodiment, however, the guide part 60 is disposed in the lower portion of the nose part 4. Accordingly, as shown in FIG. 7, the head part 100*a* of the nail 100 that tilts rearward is in contact with the guide surface 61 of the guide part 60. That is, the head part 100*a* of the nail 100 is supported by the guide surface 61 of the guide part 60 and is prevented from falling rearward. Consequently, the situation that the head part 100*a* of the nail 100 falls into the gap S is avoided.

As described above, the guide part 60 provides two functions at the same time, i.e. the function of correcting the forward tilting of the nail 100 and the function of preventing the head part 100*a* of the nail 100 that tilts rearward from falling into the gap S between the nose part 4 and the contact part 5. Therefore, clogging of the nail 100 can be prevented without lengthening the ejection passage 50 to keep the ejection port 53 far away from the gap S. Furthermore, in this embodiment, ½ or more of the guide part 60 disposed in the nose part 4 is housed in the housing groove 70 formed in the contact part 5. Thus, the total length of the ejection passage 50 constituted by the nose part 4 and the contact part 5 is further reduced and the overall height of the nail driving machine 1 decreases.

Moreover, in this embodiment, the retraction amount of the lower end 61*a* of the guide surface 61 with respect to the edge of the ejection port 53 is sufficiently small. Therefore, as shown in FIG. 7, when the head part 100*a* of the nail 100 is in contact with the lower end 61*a* of the guide surface 61, at least a portion of the head part 100*a* (in this embodiment, most of the head part 100*a*) is located in the ejection passage. Accordingly, even if the nail 100 tilts rearward, the lower end surface of the driver blade 11 is not disengaged from the head part 100*a* of the nail 100 and the striking of the head part 100*a* performed by the driver blade 11 is continued reliably.

When the nail 100 as shown in FIG. 7 is further driven into the object to be fixed, the head part 100*a* of the nail 100 passes the lower end 61*a* of the guide surface 61 and reaches the front of the housing groove 70. Thus, in this embodiment, a width (W) of the housing groove 70 shown in FIG. 4 is smaller than the diameter of the head part 100*a* of the nail 100 shown in FIG. 7. Accordingly, even after the head part 100*a* of the nail 100 shown in FIG. 7 reaches the front of the housing groove 70, the head part 100*a* does not fall into the housing groove 70. In addition, the nail driving machine body including the nose part 4 may be lifted by the recoil during the driving. In that case, the penetration length of the guide part 60 with respect to the housing groove 70 changes (decreases). However, at least a portion of the guide part 60 is in the housing groove 70 in the period from the start of the driving of the nail 100 to the end. That is, the situation that the entire guide part 60 is located outside the housing groove 70 does not occur. Accordingly, the head part 100*a* of the nail 100 is guided by the guide surface 61 of the guide part 60 or the edge of the housing groove 70 at all times.

The invention is not limited to the aforementioned embodiments, and various modifications may be made without departing from the spirit of the invention. For example, the width (W) of the housing groove 70 as shown in FIG. 4 is about 4.6 mm. However, the nail driving machine 1 is capable of driving multiple types of nails having different sizes and the width (W) of the housing groove 70 can be set according to the size of the nail to be driven by the nail driving machine 1. Nevertheless, it is preferable that the width (W) of the housing groove 70 is smaller than the diameter of the head part of the smallest nail that the nail driving machine 1 can drive.

Figure 8:
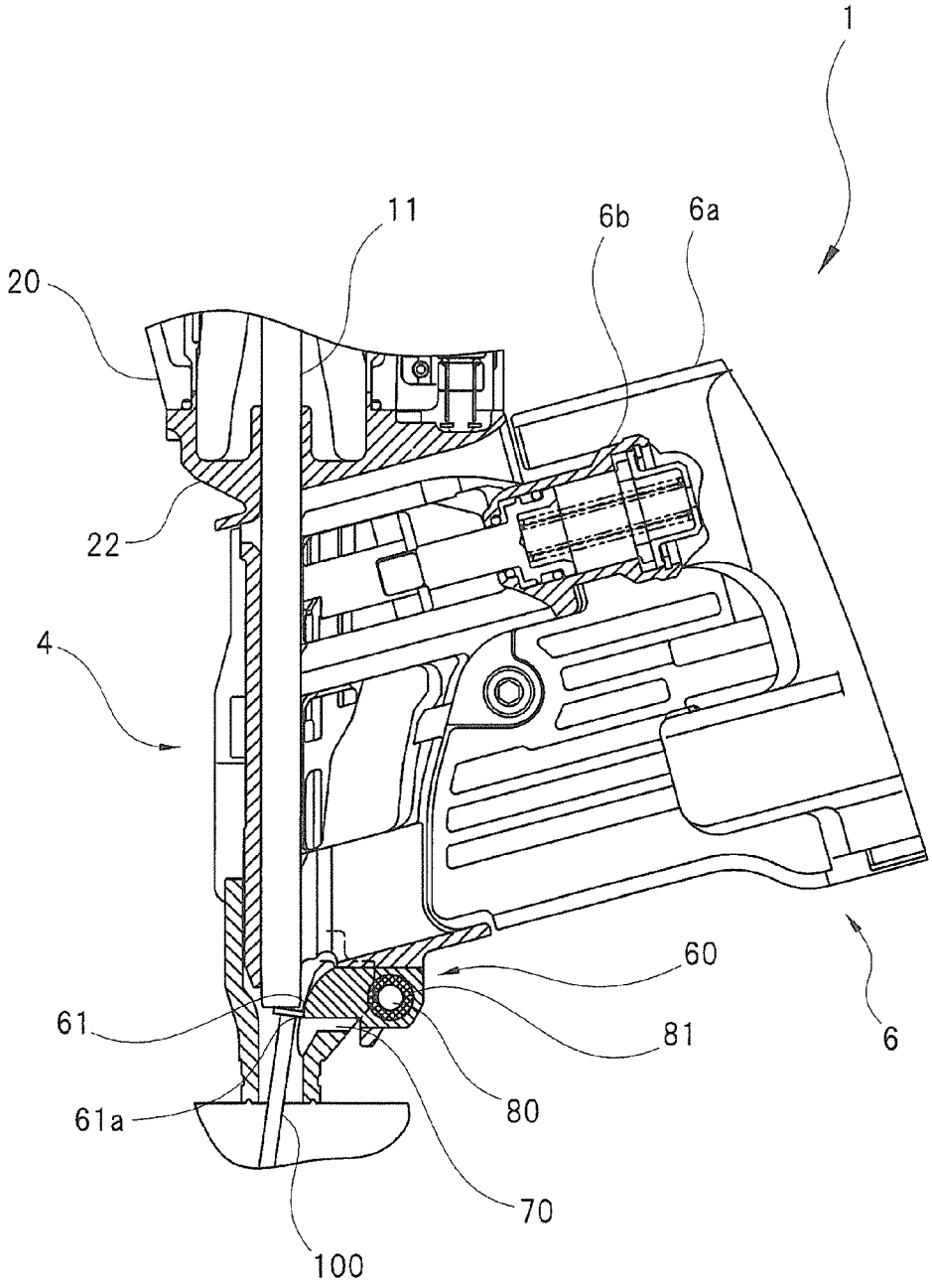
FIG. 8 is a partially enlarged cross-sectional view showing a variant of the guide part.

Moreover, the nose part 4 and the guide part 60 may be individual parts. The guide part 60 as shown in FIG. 8 is an individual member with respect to the nose part 4 and is installed to the nose part 4. The guide part 60 as shown is fitted into a groove (not shown) formed in the nose part 4. Besides, a pin 80 penetrates the nose part 4 and the guide part 60 to serve as the engaging member. Further, a cylindrical buffer member 81 is interposed between the guide part 60 and the pin 80. In this embodiment, by forming the nose part 4 and the guide part 60 into individual parts, the impact generated when the nail 100 comes in contact with the guide part 60 is transmitted as a rotational impact that uses the pin 80 as the rotation axis, so as to improve the durability of the guide part 60. In addition, the cylindrical buffer member 81 is interposed between the guide part 60 and the pin 80 to mitigate the impact and further improve the durability of the guide part 60. When the guide part 60 is worn, it is possible to replace only the guide part 60. It is also possible to replace only the buffer member 81, so as to maintain the effect of impact mitigation. The buffer member 81 as shown is made of an elastomer such as rubber. However, the material of the buffer member 81 is not limited to rubber and may also be a resin or a soft metal. In addition, the buffer member 81 is not necessarily a cylindrical structure disposed between the guide part 60 and the pin 80, and may be a structure for disposing a buffer member to the contact portion between the nose part 4 and the guide part 60.

Figure 9A:
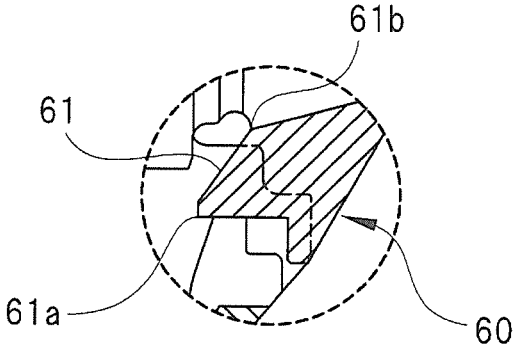
FIG. 9(*a*) and FIG. 9(*b*) are partially enlarged cross-sectional views showing different variants of the guide surface.
Figure 9B:
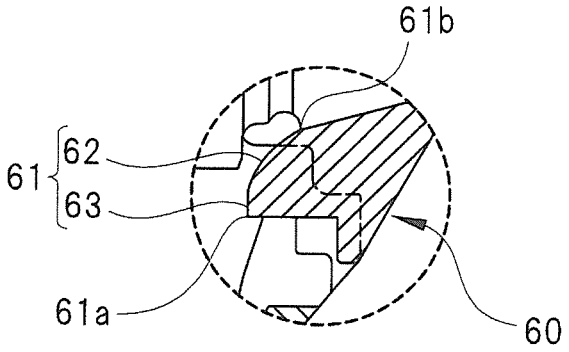

Moreover, the guide surface 61 of the guide part 60 is not necessarily a curved surface. For example, the guide surface 61 may be a plane surface that inclines downward, as shown in FIG. 9(*a*). In addition, the guide surface 61 may include a curved surface 62 and a plane surface 63, as shown in FIG. 9(*b*). If the entire guide surface 61 or a portion thereof is a curved surface, the curved surface may not have a constant curvature.

What is claimed is:

1. A driving machine for driving a fastener, which comprises a head part formed on an end of a shaft part and having a larger diameter than the shaft part, into an object to be fixed, the driving machine comprising:

a nose part forming an upper portion of an ejection passage through which the fastener passes;

a contact part being slidable along the nose part and forming a lower portion of the ejection passage;

a driver blade striking the head part of the fastener supplied to the ejection passage; and a guide part disposed in a lower portion of the nose part and guiding the fastener passing through the ejection passage, wherein the guide part comprises a curved surface serving as a guide surface that inclines to protrude from a radial outer side toward a radial inner side of the ejection passage, and wherein a housing groove is formed in the contact part and the guide part enters the housing groove when the contact part slides along the nose part, and wherein a lower end of the guide surface is disposed outside an edge of the ejection passage.

2. The driving machine according to claim 1, wherein ½ or more of the guide part enters the housing groove.

3. The driving machine according to claim 1, wherein a portion of the guide surface of the guide part housed in the housing groove forms an inner peripheral surface of the ejection passage with an inner peripheral surface of the contact part.

4. The driving machine according to claim 1, wherein a width of the housing groove is smaller than the diameter of the head part of the fastener.

5. The driving machine according to claim 1, wherein when the head part of the fastener is in contact with a portion of the guide part that is closest to a center of the ejection passage, at least a portion of the head part is located in the ejection passage.

6. The driving machine according to claim 1, wherein the nose part and the guide part are individual parts, and an engaging member is interposed between the nose part and the guide part.

7. The driving machine according to claim 6, wherein a buffer member is interposed between the nose part and the guide part.

* * * * *